United States Patent [19]

Urabe

[11] Patent Number: 4,649,377

[45] Date of Patent: Mar. 10, 1987

[54] SPLIT IMAGE DISPLAY CONTROL UNIT

[75] Inventor: Kiichiro Urabe, Hadano, Japan

[73] Assignee: Hitachi, Ltd., Tokyo, Japan

[21] Appl. No.: 613,379

[22] Filed: May 23, 1984

[30] Foreign Application Priority Data

May 24, 1983 [JP] Japan ..... 58-90982

[51] Int. Cl.[4] ..... G09G 1/06

[52] U.S. Cl. ..... 340/721; 340/749; 358/182

[58] Field of Search ..... 340/721, 723, 734, 724, 340/731, 749; 358/181, 182, 183

[56] References Cited

U.S. PATENT DOCUMENTS

| | | | |
|---|---|---|---|
| 4,107,780 | 8/1978 | Grimsdale et al. | 340/750 X |
| 4,228,433 | 10/1980 | Matsumoto | 340/749 X |
| 4,258,361 | 3/1981 | Hydes et al. | 340/734 X |
| 4,309,700 | 1/1982 | Kraemer | 340/723 X |
| 4,354,184 | 10/1982 | Woborschil | 340/731 X |
| 4,354,185 | 10/1982 | Worborschil | 340/731 X |
| 4,451,899 | 5/1984 | Yamazaki | 340/731 X |
| 4,454,593 | 6/1984 | Fleming et al. | 340/723 X |
| 4,528,693 | 7/1985 | Pearson et al. | 340/731 X |
| 4,533,910 | 8/1985 | Sukonick et al. | 340/721 |
| 4,550,315 | 10/1985 | Bass et al. | 340/723 X |
| 4,555,775 | 11/1985 | Pike | 340/734 X |
| 4,566,126 | 1/1986 | Miyagawa et al. | 358/183 X |

*Primary Examiner*—Marshall M. Curtis
*Assistant Examiner*—Vincent P. Kovalick
*Attorney, Agent, or Firm*—Antonelli, Terry & Wands

[57] ABSTRACT

A display device wherein display is carried out by scanning and a display screen is handled as an aggregation of a plurality of blocks. A display data memory for storing a data to be displayed and a control memory for defining a plurality of split images each comprising one or more blocks are provided in the display device. The display data memory is accessed by an address corresponding to the split image to which the block being scanned belongs, in accordance with the control memory.

4 Claims, 15 Drawing Figures

FIG. 8a
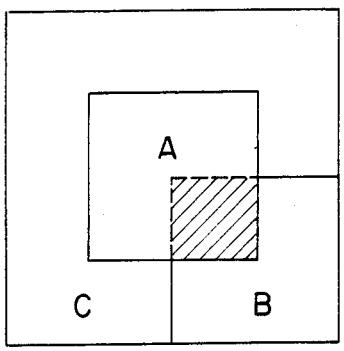
FIG. 8b
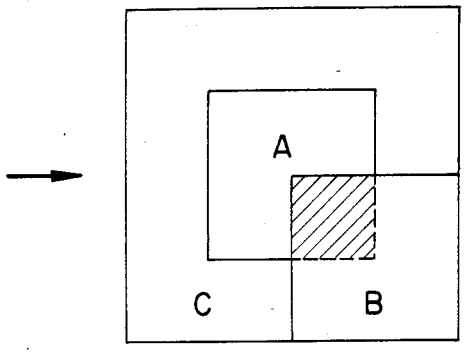
FIG. 8c
| $2^1$ | $2^0$ | ① | ② | ③ | ④ |
|---|---|---|---|---|---|
| 0 | 0 | A | B | C | D |
| 0 | 1 | B | A | C | D |
| 1 | 0 | C | A | B | D |
| 1 | 1 | D | A | B | C |

SPLIT IMAGE DISPLAY CONTROL UNIT

BACKGROUND OF THE INVENTION

1. Field of the Invention

The present invention relates to a display control system in a display device, and more particularly to a split image display control.

2. Description of the Prior Art

A split image display technique for controlling the display of split images has been known. The display control for this purpose has been implemented in two forms, i.e., a software system and a hardware system.

The software system comprises an image memory which physically corresponds to a display screen and stores information to be displayed, and a display information memory which stores coded display information. The image memory is divided into a plurality of areas by physical addresses and the display information of a selected area of the display information memory is transferred to the divisional areas.

Disadvantages of this system are that the display information must be transferred and that address translation is required therefor and hence a long processing time is required.

The hardware system is called a multi-window system. It has a memory for storing display information. The display information is read out of a plurality of areas of the memory by a hardware control and it is displayed on one display screen. A disadvantage of this system is that the control hardware is complex and of large scale as the number of areas read out (that is, the number of windows or the number of split images) increases, and hence the cost of the device increases. It also has a disadvantage of a low freedom of image splitting.

SUMMARY OF THE INVENTION

It is an object of the present invention to provide the display control system which reduces a burden to the software for controlling image splitting and which is capable of versatility in splitting images on a display screen with simple hardware.

In accordance with the present invention, a display screen is divided into areas for displaying a plurality of blocks. Split images each comprising one or more blocks are stored. A memory which stores display data is accessed by an address corresponding to the split image to which the block being scanned for display belongs.

BRIEF DESCRIPTION OF THE DRAWINGS

FIGS. 8*a* and 8*b* show examples of display image, FIG. 8*c* shows a priority order.

DESCRIPTION OF THE PREFERRED EMBODIMENTS

Figure 1:
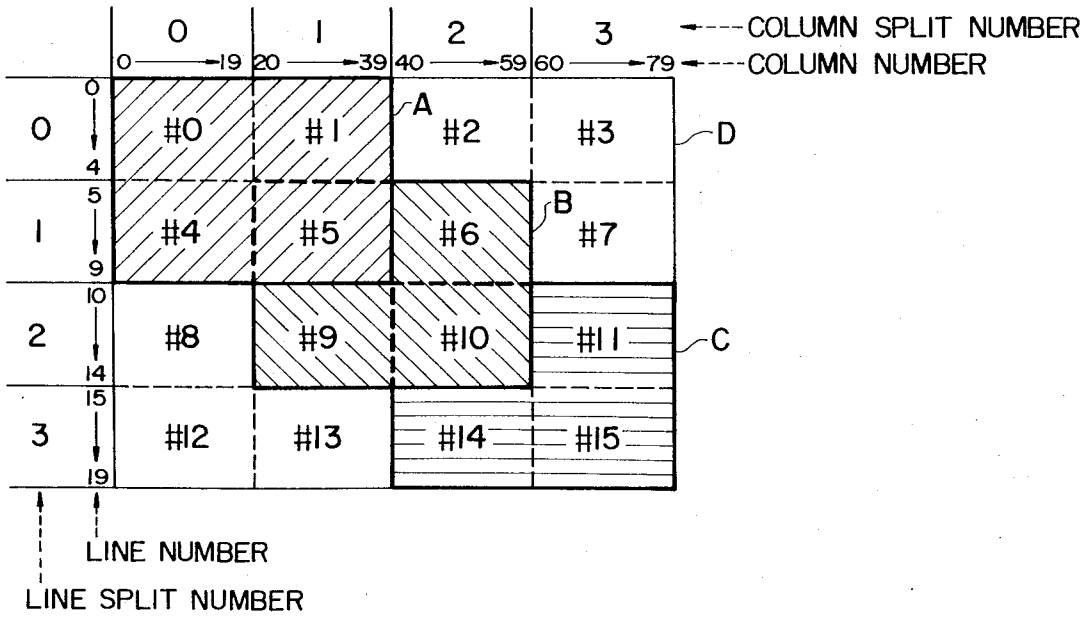
FIG. 1 illustrates a display control system and image split in accordance with the present invention.

FIG. 1 shows a concept of display control in one embodiment of the present invention. A display screen comprises twenty character lines 0–19. Numbers assigned to the respective character lines are referred to as line numbers. Each character line comprises 80 characters to which column numbers 0–79 are assigned. In the present embodiment, the display screen is divided at every fifth line and every 20th character. Thus, 16 blocks are defined on the display screen. Line split numbers and column split numbers are assigned to the respective blocks as shown. Block numbers 0–15 are also assigned to the respective blocks.

Figure 2:
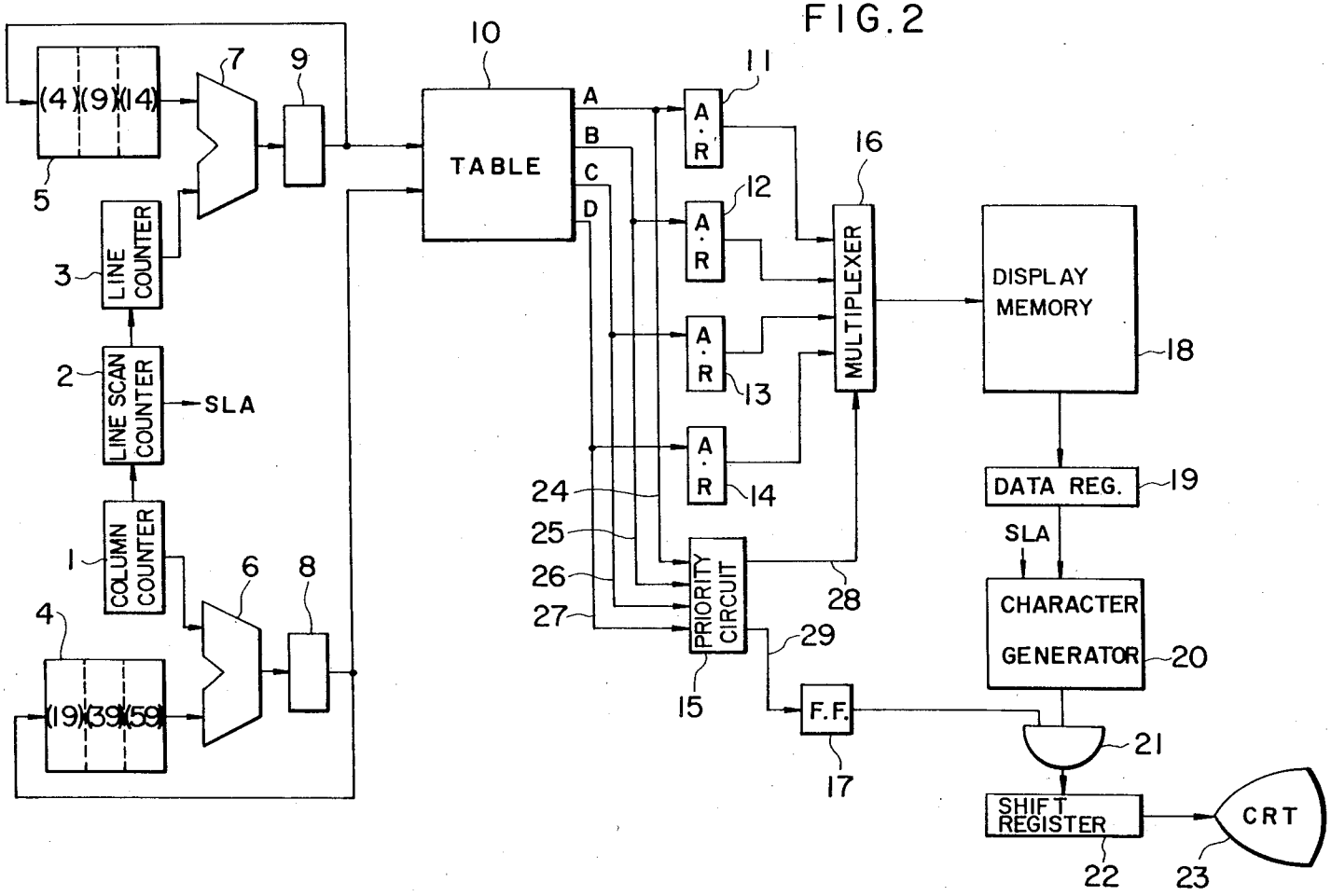
FIG. 2 shows a block diagram of one embodiment of the present invention.

FIG. 2 is a block diagram of one embodiment of the present invention. In order to indicate a scan position on a screen of a CRT 23, a column counter 1 for indicating a position in one character line, a line-scan counter 2 for counting the number of line-scans in one character line and a line counter 3 for indicating a line number in the screen are provided. As described above, the image screen is divided into a plurality of blocks in matrix form. In order to indicate the block being scanned, a column split designation register 4 in which last column numbers of the blocks are stored, a comparator 6 for comparing an output from the register 4 with the content of the column counter 1 and a column split counter 8 for counting an output of the comparator 6 are provided. The column split counter 8 produces the column split number of the block being scanned, and it is counted up by one when the comparator 6 detects the equality of the inputs thereto. The output of the column split counter 8 is supplied to the column split designation register 4 as a read address so that the last column number of the block which is right-adjacent to the block being scanned is read out from the column split designation register 4. The lateral block split has been described above. For a longitudinal column split, a line split designation register 5 in which last line numbers of the laterally arranged blocks are stored, a comparator 7 which compares an output of the register 5 with the content of the line counter 3, and a line split counter 9 which is counted up by one by a compare equal output from the comparator 7 to produce the line split number of the block being scanned are provided. The line split number outputted by the line split counter 9 is supplied to the line split designation register 5 as a read address so that the last line number of the block which is below the block being scanned is produced by the line split designation register 5.

The last column numbers described above are the last column numbers of the respective blocks and they are 19, 39 and 59 in the example of FIG. 1. The last line numbers described above are the last line numbers of the respective blocks and they are 4, 9 and 14 in the example of FIG. 1.

The column split counter 8 is initially set to "0". The content "19" in the left column of the register 4 is supplied to the comparator 6. When the content of the column counter 1 reaches "19", the column split counter 8 is updated to "1". Then, the content "39" in the middle column of the register 4 is supplied to the comparator 6, and when the content of the column counter 1 reaches "39", the column split counter 8 is updated to "2". Then, the content "59" of the right column of the register 4 is supplied to the comparator 6, and when the content of the column counter 1 reaches "59", the column split counter 8 is updated to "3". When the content of the column counter 1 reaches "79", the column split counter 8 is reset to "0". In this manner, the column split number under scan is stored in the column split counter 8. Similarly, the line split number under scan is stored in the line split counter 9. This block address is used as a read address for a split control table 10.

The split control table 10 contains two or more tables of the split image versus the block and discriminates the split image to which the block being scanned belongs, and outputs the discrimination result by a four-bit signal 24–27. In the present embodiment, up to four split images can be set in the split control table 10. For example, when a split image A comprising the four blocks #0, #1, #4 and #5, a split image B comprising the four blocks #5, #6, #9 and #10, a split image C comprising the four blocks #10, #11, #14 and #15, and a split image D comprising all blocks #0–#15 are to be defined as shown in FIG. 1, the split control table 10 contains "1's" for those of the blocks #0–#15 which are included in the split images A, B, C and D, respectively, and "0's" for those blocks which are not included in the split images A, B, C and D respectively. The table is looked up by the block number and a signal representing the split image for which "1" is stored is outputted.

Returning to FIG. 2, numerals 11–14 denote address registers for addressing a display data memory 18 which stores display data in a character code format. They are independently operated under the control of the signals 24–27. Numeral 15 denotes a priority circuit which determines a priority order of the output signals 24–27 of the split control table 10. It produces an address select signal 28 to select the highest priority one of the split images for which "1's" are stored. The priority order determines which split image data is to be displayed in the block such as the block #5 of FIG. 1 which belongs to two or more split images. The priority order is assigned to each split image. The priority order is variable. Numeral 16 denotes a multiplexer which selects an output of one of the address registers 11–14 by the address select signal 28 and supplies it to the display memory 18. The character code read therefrom is temporarily latched in a data register 19. The latched character code and the output SLA from the line scan counter 2 are supplied to a character generator 20 as a read address and translated to a character pattern. The character pattern from the character generator 20 is loaded in a shift register 22 where it is converted to a serial pattern, which is then supplied to a CRT unit 23. The processing after the data register 19 is similar to that of the prior art.

The priority circuit 15 produces a display valid signal 29 which is a logical OR function of the signals 24–27. The display valid signal 29 is on during a display valid period and controls an AND gate 21 inserted between the character generator 20 and the shift register 22. Numeral 17 denotes a flip-flop which synchronizes the character code read from the display memory 18 with the display valid signal 29.

Figure 3:
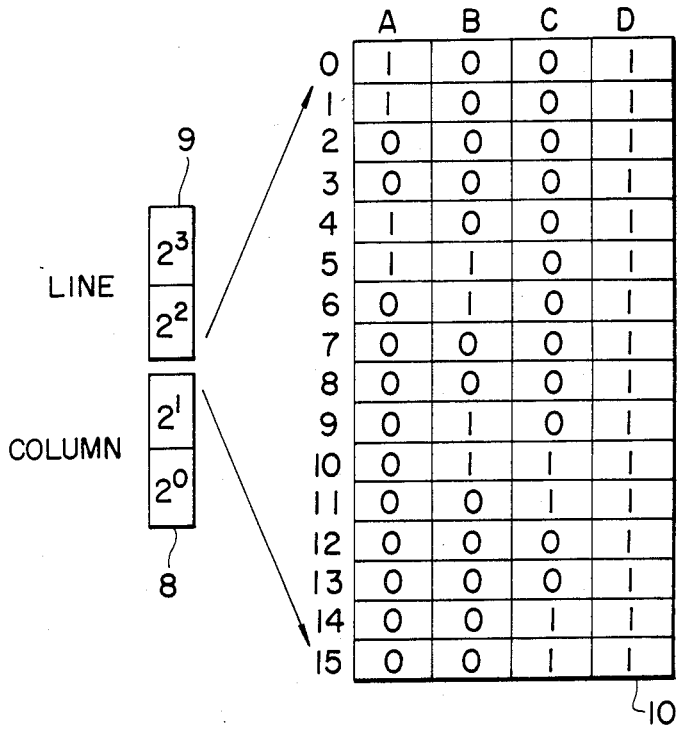
FIG. 3 shows a table in the embodiment of the present invention.

Assuming that the table 10 is set as shown in FIG. 3, if the block address specified by the registers 8 and 9 is "0", "1's" are read out for the split images A and D and the signals 24 and 27 are "1's" and the address counters 11 and 14 for the split images A and D are counted up in synchronism with the line scan. When the block address is "10", the signals 25, 26 and 27 are "1's" and the address counters 12, 13 and 14 for the split images B, C and D are counted up. The address registers 11–14 are initialized during a vertical retrace period of the line scan.

When only one of the signals 24–27 is "1", the priority circuit 15 controls the multiplexer 16 by the address select signal 28 to select the output of one of the address counters corresponding thereto. When two or more of the signals 24–27 are on, one of the address registers which corresponds to the highest priority one of the "1" signals is selected in accordance with a predetermined priority order (which will be described later). If the priority order is assigned to the split images in the order of the split images A, B, C and D from the highest priority to lower priorities, the images are displayed in a manner shown in FIG. 1 and an area which overlaps with a higher priority split image is not displayed. Such a priority control is necessary to assure that, when a plurality of split images which shares one block are defined, the display data for a desired split image can be displayed on that block so that the freedom of the image split is increased. If such an advantage is not expected, the priority circuit 15 may be omitted and the signals 24–25 may be supplied directly to the multiplexer 16 as the address select signal 28, or the priority order of the priority circuit 15 may be fixed.

Figure 4:
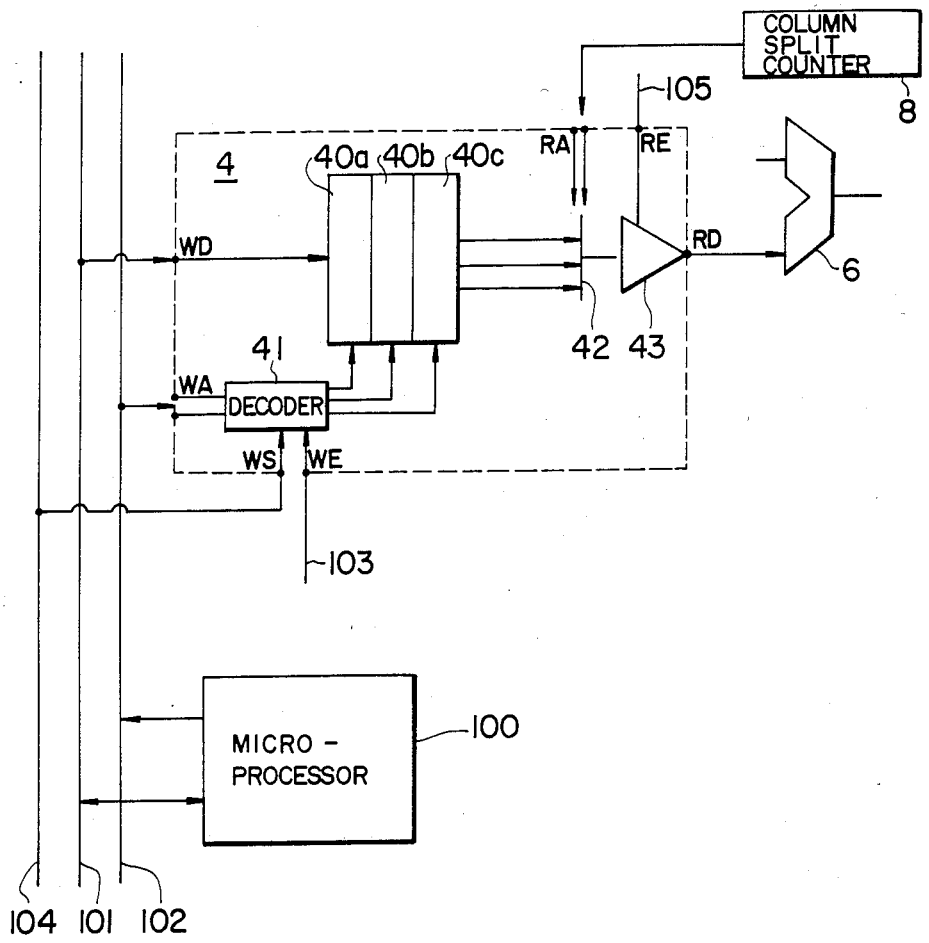
FIG. 4 shows a detail of a column split designation register and a control circuit therefor.

FIG. 4 is a block diagram showing a circuit configuration of the column split designation register 4 and the control circuit therefor. The line split designation register 5 has a similar configuration.

In FIG. 4, numerals **40*a*–40*c* denote 16-bit registers. In order to write the data to the registers 40*a*–40*c*, 16-bit data is set in a data bus 101 of a microprocessor 100, an address for specifying the register to which the data is written is set in an address bus 102 and a write enable line 103 is activated. When a write strobe line 104 is on, a load pulse is supplied from a decoder 41 to one of the registers 40*a*–40*c* which is specified by the address on the address bus 102 and the 16-bit data on the data bus 101** is written in parallel to the specified register.

Numeral 42 denotes a multiplexer which selects one of the registers **40*a*–40*c* which is specified by the column number supplied from the column split counter 8 and supplies the output of the selected register to an output gate 43. The output gate 43 supplies the input data to one input of the comparator 6 while the output enable line 105** is on.

Figure 5:
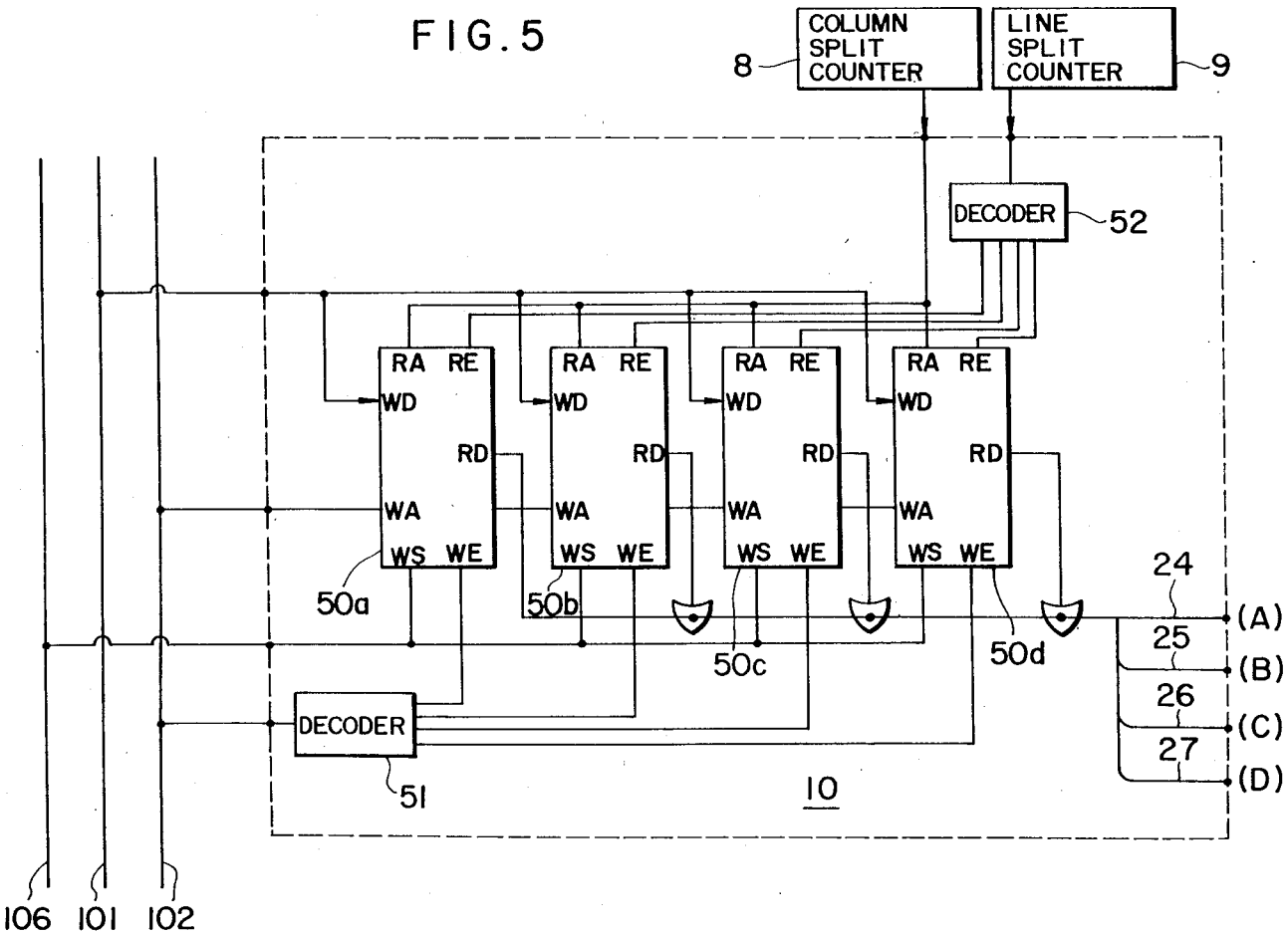
FIG. 5 shows a detail of the table of FIG. 2.

FIG. 5 is a block diagram showing a circuit configuration of the split control table 10 and the control circuit therefor.

Numerals **50*a*–50*d* denote 16 words×1 bit RAM's which form a 16 words×4 bits memory. By supplying an address for specifying a word to the address bus 102, a write enable signal is supplied from a decoder 51 to all of the RAM's 50*a*–50*d*, and when a write strobe line 106 is activated, the 4-bit data on the data bank 101 is written into the specified word. The data is written during the vertical retrace period of the CRT unit 23**.

The read address of the RAM's **50*a*–50*d* is specified by the output of the column split counter 8. Each time when the decoder 52** produces the read enable signals, the 4-bit data is read from the RAM's, one bit from each RAM.

FIGS. **6*a*–6*d*** show other examples of the image split and the setting data.

Figure 6A:
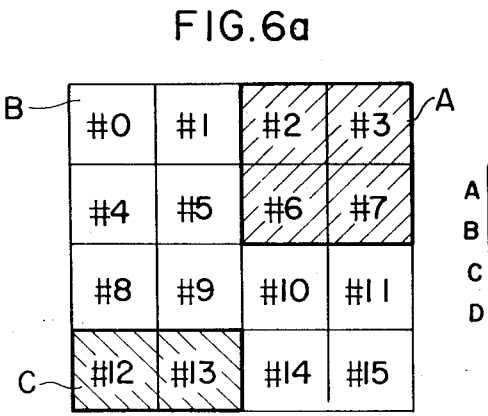
FIG. 6*a* shows another example of the image split.
Figure 6B:
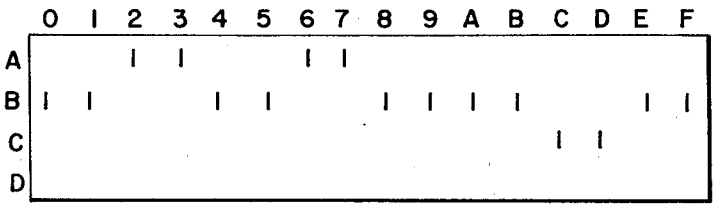
FIG. 6*b* shows a content of a table in the image split.
Figure 6C:
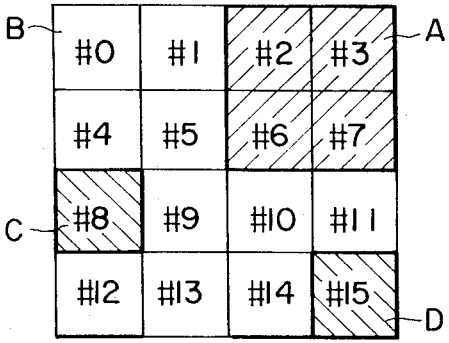
FIG. 6*c* shows other example of the image split.
Figure 6D:
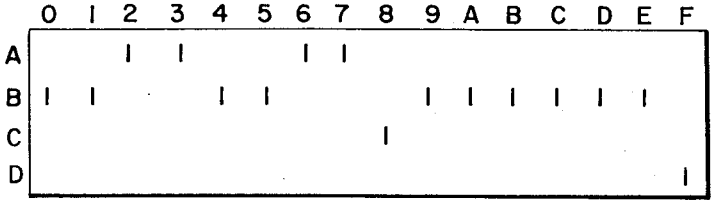
FIG. 6*d* shows a content of a table in the image split.

In FIG. 6*a*, the display screen is split into three split images A (four blocks #2, #3, #6 and #7), B (ten blocks #0, #1, #4, #5, #8, #9–#11, #14 and #15) and C (two blocks #12 and #13). There is no overlap of the blocks. In this example, a data shown in FIG. 6*b* is set in the 16 words×4 bits memory of the split control table 10. In FIG. 6*c*, the display screen is split to four split images A–D (without overlap of the blocks), and FIG. 6*d* shows a data set in the memory. In FIGS. 6*b* and 6*d*, blanks show "0" bits.

Figure 7:
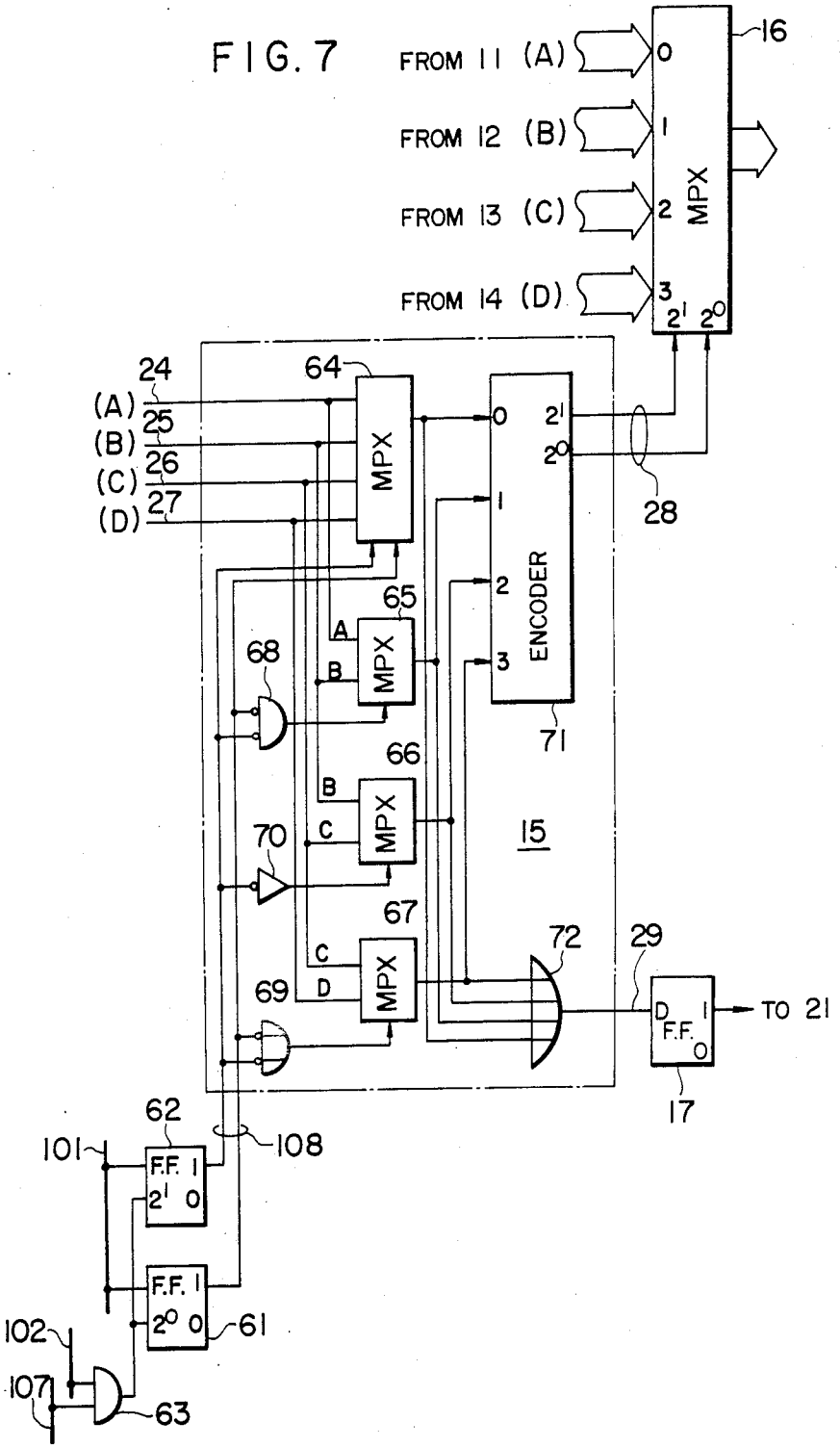
FIG. 7 is a block diagram of a priority circuit.

FIG. 7 is a block diagram showing a circuit configuration of the priority circuit 15 and a control circuit therefor.

Numerals 61 and 62 denote flip-flops to which a priority order data (2 bits) are set from the microprocessor 100 (FIG. 4). When the flip-flops 61 and 62 are specified by the address bus 102, the data on the data bus 101 is set to the flip-flops 61 and 62 when the strobe signal 107 is turned on and the output of the gate 63 is turned on.

Numerals 64–67 denote multiplexers. The output signals (priority order signals ) 108 of the flip-flops 61 and 62 are supplied to the 4-input multiplexer 64 as a select signal, output signals of gates 68 and 69 which receive the priority order data 108 are supplied to the 2-input multiplexers 65 and 67 as a select signal, and an inversion of the output signal of the flip-flop 62, inverted by an inverter 70 is supplied to the 2-input multiplexer 66 as a select signal. Numeral 71 denotes a 4-input priority encoder which encodes the output signals of the multiplexers 64–67 in accordance with a fixed priority order to produce the address select signal 28 (2 bits). (The multiplexers 64–67 are assigned with the priority order in this sequence). The output signals of the multiplexers 64–67 are ORed by a gate 72 to produce the display valid signal 29, which is supplied to the flip-flop 17.

FIG. 8 illustrates the operation of the priority circuit 15. Let us assume that the display screen is divided into three split images A, B and C as shown in FIGS. 8*a* and 8*b*, with the split images A and B overlapping at a hatched area. FIG. 8*c* shows the relation between the priority order data and the priority order. When the priority order data is set to "00", the split image A has a higher priority than the split image B and the images are displayed in a manner shown in FIG. 8*a*. If the images are to be displayed in a manner shown in FIG. 8*b*, the priority order data is set to "01".

Figure 9:
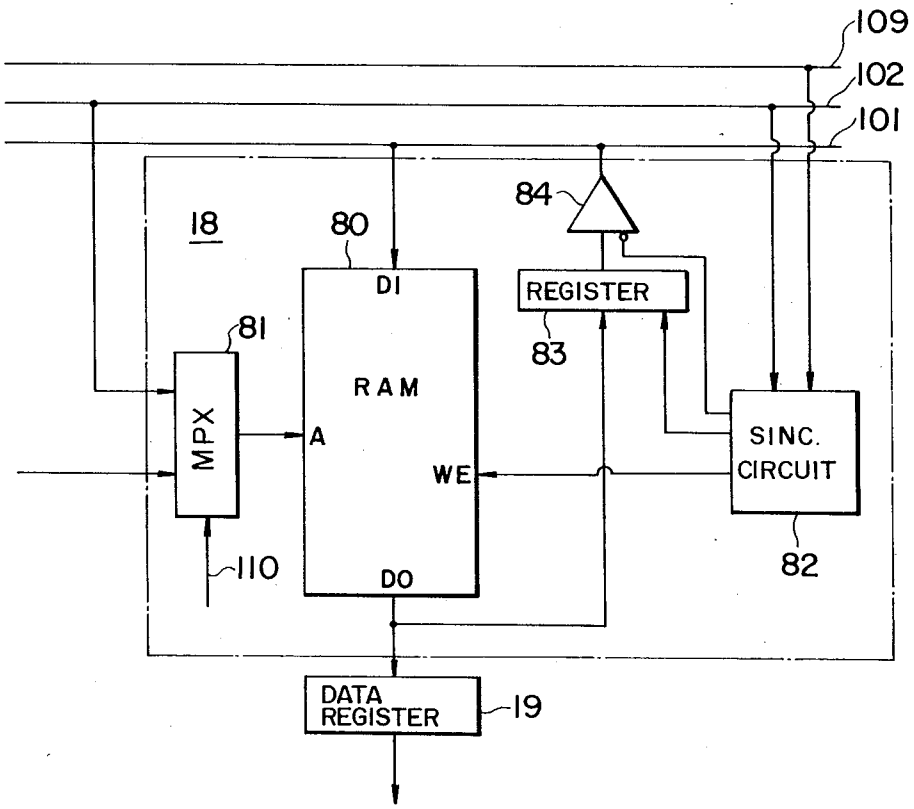
FIG. 9 is a block diagram of a display memory.

FIG. 9 is a block diagram of the display data memory 18. Numeral 80 denotes a RAM, numeral 81 denotes a multiplexer and numeral 82 denotes a synchronization circuit. Numerals 83 and 84 denote a rewrite register and a gate (tri-state gate) for the RAM 80 respectively. The multiplexer 81 selects the address on the address bus 102 during the on-period of the select signal 110 and supplies it to an address input of the RAM 80, and selects the address supplied from the multiplexer 16 during the off-period of the select signal 110 and supplies it to the RAM 80. The synchronization circuit 82 controls the write enable signal (WE) such that the RAM 80 is operated in the write mode during the on-period of the select signal 110 and in the read mode during the off-period. It also controls the register 83 and the gate 84. The synchronization circuit 82 is controlled by the microprocessor through the address bus 102 and the control signal 109.

Figure 10:
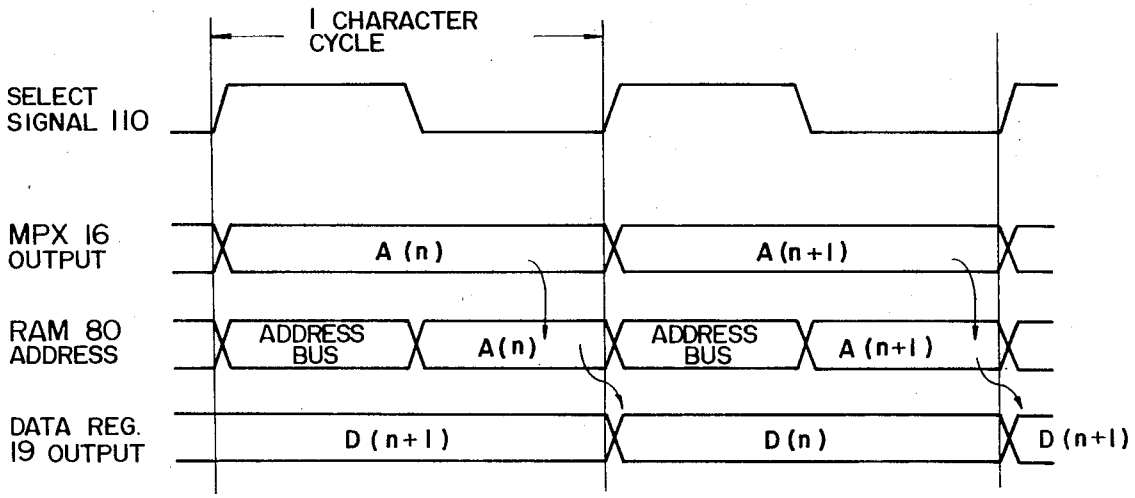
FIG. 10 is a timing chart of the display memory of FIG. 9.

FIG. 10 shows an operation timing chart of the display memory 18. The display memory 18 is accessed by the microprocessor in a first half of one character cycle, and accessed by the display unit in a second half of the cycle.

While preferred embodiments of the present invention have been described in detail, the present invention is not limited to those embodiments but many modifications may be made.

For example, the specific bit outputs of the column counter 1 and the line counter 3 may be supplied directly to the split control table 10 as the block address while omitting the blocks 4–9, although this leads to the reduction of the freedom of the split position of the split image. As an example, if the image on the display screen is to be laterally split at an interval of 32 characters, the high order two bits of the column counter 1 (7-bit binary counter) may be used as the lateral split address.

Five or more split images can be defined by increasing the memory capacity of the split control table 10 and the address registers (11–14).

While the display data is in the form of a character code in the above embodiments, a graphic display can be attained by storing graphic pattern dot data in the display memory 18 and reading it into the shift register 22. Such a modification can be made by conventional technique. It is desirable to designate the graphic display and the character display for each split image.

As described hereinabove, according to the present invention, the image on the display screen can be split with more versatility with relatively simple hardware. Since the split images are defined by the combination of the blocks, the number of image defining parameters to the hardware is reduced and the software processing is reduced.

I claim:

1. A control unit for a display device having a display screen partitioned into a plurality of areas in the form of blocks for displaying a plurality of split images each consisting of one or more blocks, comprising:

block detection means for detecting one of said blocks in which a scanning location on the display screen is contained, including column split memory means for storing lateral block split positions on the display screen, line split memory means for storing longitudinal block split positions on the display screen, position information generation means for generating position information indicating the scanning position on the display screen, said block designation means for comparing the position information with the contents of said column split memory means and said line split memory means, respectively, and for generating a block designation signal to designate the block in which the scanning position is contained;

a display data memory for storing data to be displayed;

conversion means responsive to said block detection means for producing split image signals each indicating the split image to which the detected block belongs; and address control means responsive to the split image signals for generating a read address for said display data memory for each split image;

said display data memory being accessed by the read address.

2. A control unit for a display device according to claim 1, wherein said column split memory means stores a plurality of block split positions and is rewritable, and said line split memory means stores a plurality of block split positions and is rewritable.

3. A control unit for a display unit according to claim 1, wherein said conversion means is accessed by said block designation signal and comprises means for storing the information indicating the split image to which the block belongs, said storing means having a plurality of rewritable memory areas.

4. A control unit for a display device according to claim 1, wherein said address control means generates the read address for one of the split image signals selected in accordance with a predetermined priority order.

* * * * *